US008444466B2

(12) United States Patent
Thomas

(10) Patent No.: US 8,444,466 B2
(45) Date of Patent: May 21, 2013

(54) WAGERING GAME WITH GAME-PLAY INTERRUPTION FEATURE

(75) Inventor: Alfred Thomas, Las Vegas, NV (US)

(73) Assignee: WMS Gaming Inc., Waukegan, IL (US)

( * ) Notice: Subject to any disclaimer, the term of this patent is extended or adjusted under 35 U.S.C. 154(b) by 2889 days.

(21) Appl. No.: 10/946,867

(22) Filed: Sep. 22, 2004

(65) Prior Publication Data

US 2006/0063583 A1 Mar. 23, 2006

(51) Int. Cl.
*A63F 9/24* (2006.01)

(52) U.S. Cl.
USPC ..... 463/16; 463/21

(58) Field of Classification Search
USPC ..... 463/16, 21
See application file for complete search history.

(56) References Cited

U.S. PATENT DOCUMENTS

| | | | | |
|---|---|---|---|---|
| 6,089,975 | A | 7/2000 | Dunn | 463/16 |
| 6,089,976 | A * | 7/2000 | Schneider et al. | 463/16 |
| 6,517,433 | B2 * | 2/2003 | Loose et al. | 463/20 |
| 6,602,137 | B2 * | 8/2003 | Kaminkow et al. | 463/16 |
| 6,695,699 | B2 | 2/2004 | Beaulieu | 463/25 |
| 7,175,523 | B2 * | 2/2007 | Gilmore et al. | 463/16 |
| 7,247,096 | B2 | 7/2007 | Vancura | 463/25 |
| 7,258,609 | B2 * | 8/2007 | Nordman et al. | 463/20 |
| 2003/0157978 | A1 * | 8/2003 | Englman | 463/16 |

OTHER PUBLICATIONS

IGT "Ghost Island™ Video Reel Slots" web page, 2 pages.
Konami—The New Wave in Gaming Wild Magic™ web page, 2 pages.

* cited by examiner

*Primary Examiner* — David L Lewis
*Assistant Examiner* — Robert Mosser
(74) *Attorney, Agent, or Firm* — Nixon Peabody LLP

(57) ABSTRACT

A method for conducting a wagering game includes receiving a wager from a player to play a basic wagering game. The method further includes displaying the basic wagering game on a video display. The method further includes interrupting the basic wagering game. A secondary game is initiated once the basic game is interrupted. The method further includes displaying an outcome for the basic wagering game after the secondary game has been completed.

38 Claims, 8 Drawing Sheets

WAGERING GAME WITH GAME-PLAY INTERRUPTION FEATURE

FIELD OF THE INVENTION

The present invention relates generally to wagering games and, more particularly, to a wagering game with a game-play interruption feature.

BACKGROUND OF THE INVENTION

Gaming terminals, such as slot machines, video poker machines and the like, have been a cornerstone of the gaming industry for many years. Generally, the popularity of such machines with players is dependent on the likelihood (or perceived likelihood) of winning money at the gaming terminal and the intrinsic entertainment value of the machine relative to other available gaming options. Where the available gaming options include a number of competing machines and the expectation of winning on each machine is roughly the same (or believed to be the same), players are most likely to be attracted to the most entertaining and exciting machines. Shrewd operators constantly strive to employ the most entertaining and exciting machines available because such machines attract frequent play and, hence, increase profitability to the operator.

One concept that has been successfully employed to enhance the entertainment value of a game is that of a "secondary" or "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game. Another method of attracting players to gaming terminals is by providing a familiar theme which a player immediately recognizes.

SUMMARY OF THE INVENTION

According to one embodiment of the present invention, a method for conducting a wagering game is disclosed. The method comprises receiving a wager from a player to play a basic wagering game. The method further comprises displaying the basic wagering game on a video display. The method further comprises interrupting the basic wagering game. A secondary game is initiated once the basic game is interrupted. The method further comprises displaying an outcome for the basic wagering game after the secondary game has been completed.

According to one embodiment of the present invention, a method for conducting a wagering game is disclosed. The method comprises receiving a wager from a player to play a basic wagering game. The method further comprises displaying the basic wagering game on a video display. The basic wagering game includes a plurality of reels capable of being moved with each reel including a plurality of symbols. The method further comprises interrupting the basic wagering game. The method further comprises initiating a secondary game after interrupting the basic wagering game. The method further comprises awarding a bonus-award to the player at the conclusion of the secondary game. The bonus-award value is determined by the secondary game. The method further comprises displaying an outcome for the basic wagering game after the secondary game has concluded.

According to one embodiment of the present invention, a method for conducting a wagering game is disclosed. The method comprises receiving a wager from a player to play a slot game. The slot game includes a plurality of symbol-bearing reels adapted to be moved. The method further comprises moving the plurality of symbol-bearing reels. The method further comprises interrupting the slot game with a visual element. The visual element covers at least a portion of the moving plurality of symbol-bearing reels. The method further comprises initiating a secondary game after interrupting the slot game. The method further comprises awarding a bonus-award to the player at the conclusion of the secondary game. The bonus-award value is determined by the secondary game. The method further comprises displaying an outcome for the slot game after the bonus-award has been awarded. The outcome for the basic wagering game is independent from the bonus-award.

According to one embodiment of the present invention, a method for conducting a wagering game is disclosed. The method comprises receiving a wager from a player to play a basic wagering game. The method further comprises displaying the basic wagering game on a video display. The method further comprises interrupting the basic wagering game. A secondary game is initiated once the basic game is interrupted. The secondary game includes a plurality of user-selectable objects. The method further comprises selecting at least one of the user-selectable objects, via player selection. The selected user-selectable object is located between at least two secondary objects. The method further comprises providing an accompanying award value for each of the at least two secondary objects. The method further comprises awarding a bonus-award to the player at the conclusion of the secondary game. The bonus-award's value is determined by combining the accompanying award values for each of the at least two secondary objects. The method further comprises displaying an outcome for the basic wagering game after the bonus-award has been awarded.

According to one embodiment of the present invention, a gaming system capable of conducting a wagering game is disclosed. The gaming system comprises a wager receptor, a display, an input device, a system memory and a processor. The wager receptor is for receiving a wager from a player to play a basic wagering game. The display is for displaying (i) a plurality of reels adapted to be moved, and (ii) a secondary game, the secondary game including a plurality of user-selectable objects located between a plurality of secondary objects. The input device is adapted to allow the player to select one or more of the user-selectable objects included in the secondary game. The system memory is capable of storing an accompanying award value pool and a pay table thereon. The processor is coupled to the system memory, the input device, and the display. The processor is operative to (i) associate each of the selected accompanying award values with at least one of the secondary objects, (ii) determine a bonus-award value by combining the accompanying award values for each of the secondary objects adjacent the selected user-selectable object, (iii) award the player the determined bonus-award value, and (iv) display an outcome for the basic wagering game after the bonus-award has been awarded.

According to one embodiment of the present invention, a gaming system capable of conducting a wagering game is disclosed. The gaming system comprises a wager receptor, a main display, a secondary display, an input device, a system memory and a processor. The wager receptor is for receiving a wager from a player to play a basic wagering game. The main display is for displaying a basic wagering game. The secondary display is for displaying a secondary game. The input device is adapted to allow the player to interact with both the basic wagering game and the secondary game. The system memory is capable of storing a basic wagering game pay table and a secondary game award pool thereon. The processor is coupled to the system memory, the input device, the main display, and the secondary display. The processor is operative to (i) determine a bonus-award value based on the result of the secondary game when compared to the award pool, (ii) award the player the determined bonus-award value, and (iii) display an outcome for the basic wagering game after the bonus-award has been awarded. The displayed outcome for the basic wagering game being independent from the secondary game.

The above summary of the present invention is not intended to represent each embodiment, or every aspect, of the present invention. Additional features and benefits of the present invention are apparent from the detailed description, figures, and claims set forth below.

Figure 1:
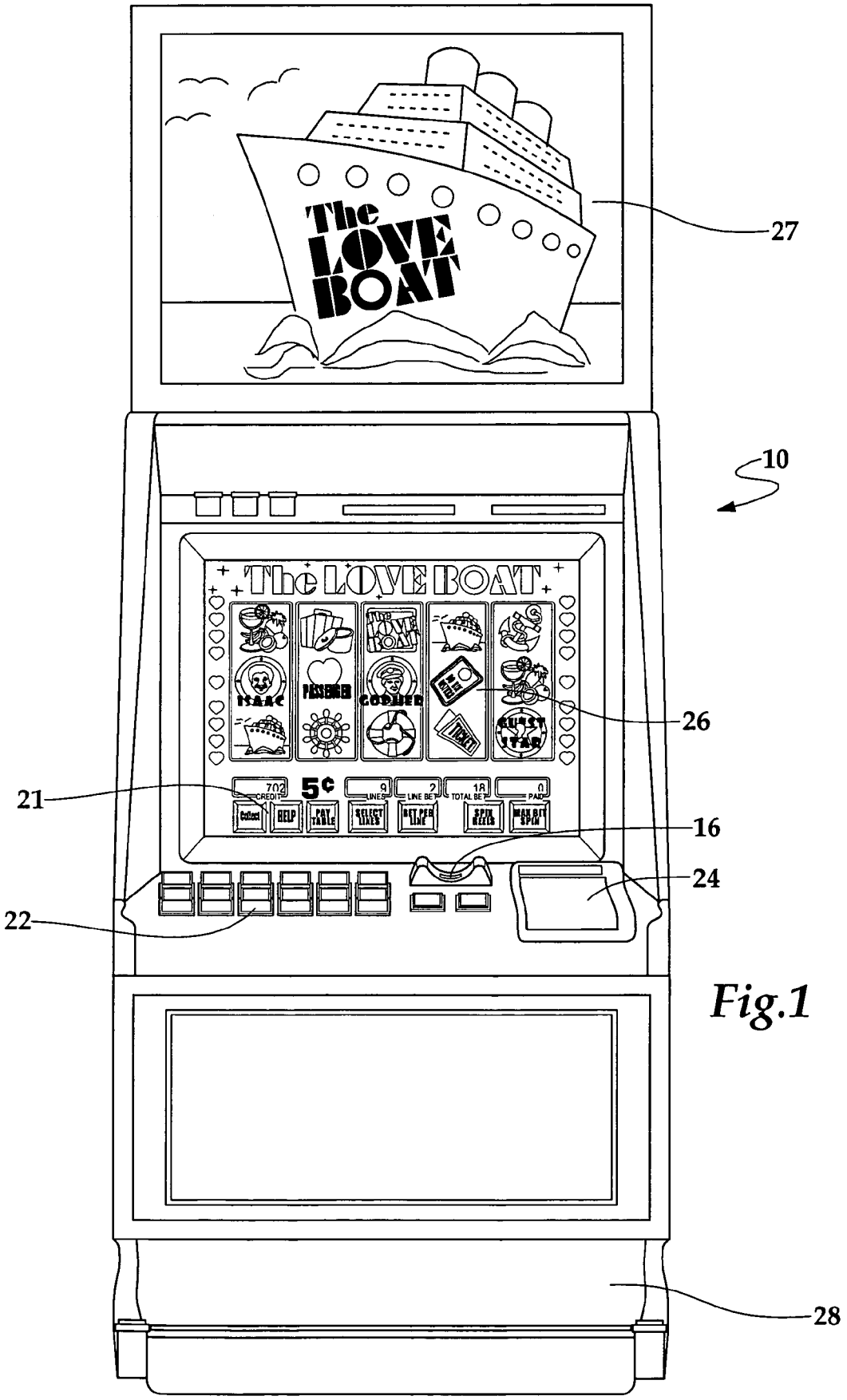
FIG. 1 is a perspective view of a gaming terminal according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENTS

Turning now to the drawings, FIG. 1 is a perspective view of a gaming terminal 10 according to one embodiment of the present invention. The gaming terminal 10 is operable to conduct a wagering game. With regard to the present invention, the gaming terminal 10 may be any type of gaming terminal and may have varying structures and methods of operation.

The gaming terminal 10 includes input devices, such as a wager acceptor 16, a touch screen 21, a push-button panel 22, and a player-identification card reader 24. For outputs, the gaming terminal 10 includes a payout mechanism 23, a main display 26 for displaying information about a basic wagering game such as video poker and a secondary display 27 for displaying additional game-play or instructional information, and an output receptacle 28 coupled to the payout mechanism 23 for providing tokens or coins to the player when the player selects to cash out. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The wager acceptor 16 may include one or both of a coin slot acceptor or a currency note acceptor to input value to the gaming terminal 10. Additionally, the wager acceptor 16 may include a card-reading device for reading a card that has a recorded monetary value with which it is associated. The card may also authorize access to a central account, which can transfer money to the gaming terminal 10.

The payout mechanism 23 performs the reverse functions of the wager acceptor 16. For example, the payout mechanism 23 may include a coin dispenser or a note dispenser to output value from gaming terminal 10. Also, the payout mechanism 23 may be adapted to receive a card that authorizes the gaming terminal 10 to transfer credits from the gaming terminal 10 to a central account.

The push button panel 22 is typically offered, in addition to the touch screen 21, to provide players with an option of how to make their game selections. Alternatively, the push button panel 22 provides inputs for one aspect of operating the game, while the touch screen 21 allows for inputs needed for another aspect of operating the game.

The operation of the basic wagering game is displayed to the player on the main display 26. The main display 26 and the secondary display 27 may take the form of a cathode ray tube (CRT), a high resolution LCD, a plasma display, LED, or any other type of video display suitable for use in the gaming terminal 10. As shown, the main display 26 includes the touch screen 21 overlaying the entire monitor (or a portion thereof) to allow players to make game-related selections. Similarly, a touch screen may overlay the secondary display 27.

The player-identification card reader 24 allows for the identification of a player by reading a card with information indicating the player's true identity. Currently, the identification is used by casinos for rewarding certain players with complimentary services or special offers. For example, a player may be enrolled in the gaming establishment's players' club and may be awarded certain complimentary services as that player collects points in the player's player-tracking account. The player inserts the player's card into the player-identification card reader 24, which allows the casino's computers to register that player's wagering at the gaming terminal 10.

Figure 2:
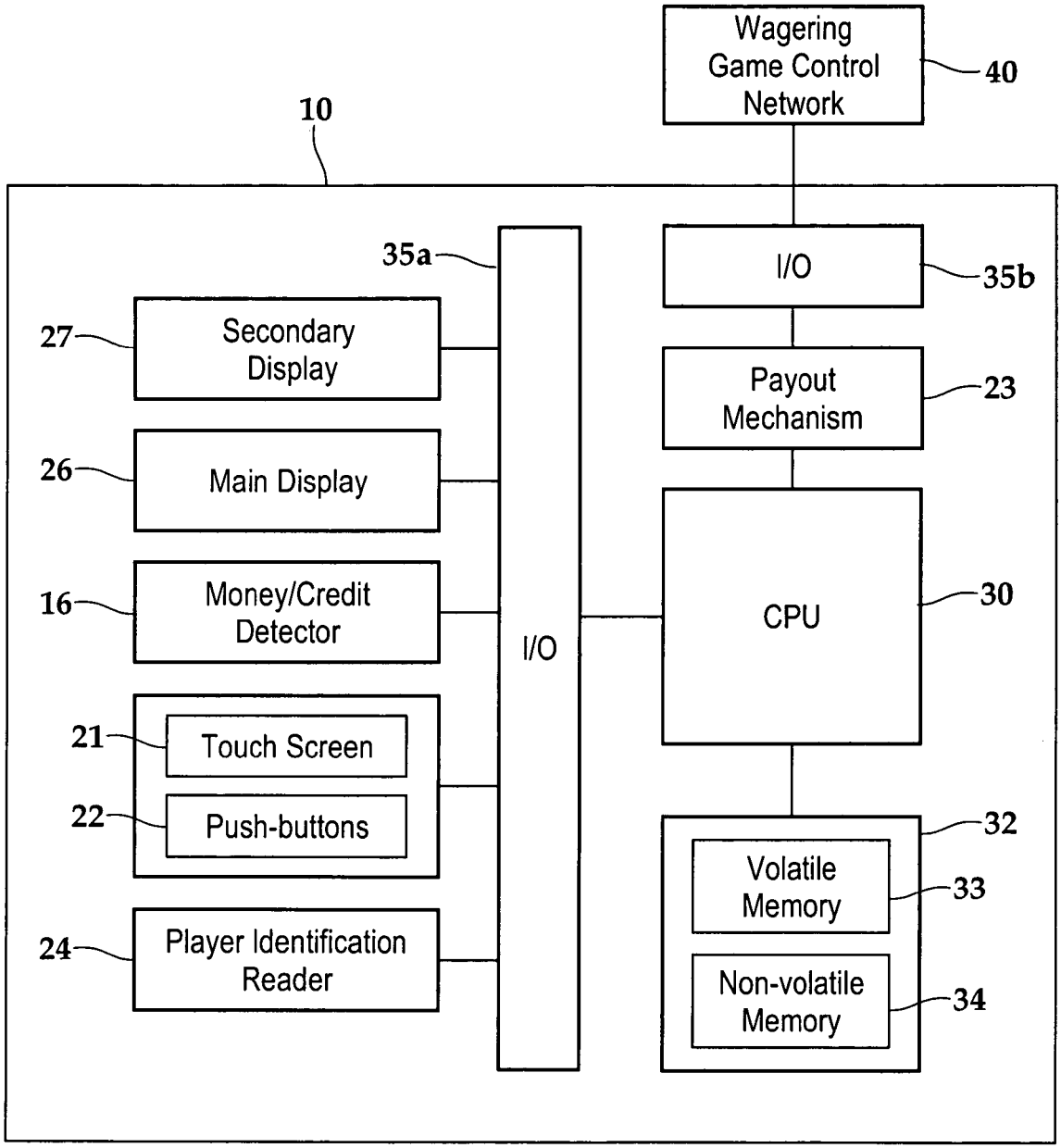
FIG. 2 illustrates a control system that is used in conjunction with the gaming terminal of FIG. 1.

Referring also to FIG. 2, the various components of the gaming terminal 10 are controlled by a central processing unit (CPU) 30 (such as a microprocessor or microcontroller). To provide the gaming functions, the CPU 30 executes a game program. The CPU 30 is also communicatively coupled to or includes a system memory 32. The system memory 32 may comprise a volatile memory 33 (e.g., a random-access memory, "RAM") and a non-volatile memory 34 (e.g., an EEPROM). It should be appreciated that the CPU 30 may include one or more microprocessors. Similarly, the memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

The gaming terminal 10 is typically operated as part of a game control network 40 having control circuitry and memory devices, wherein a plurality of gaming terminals are coupled to the game control network 40. The game control network 40 can be the game controller that controls operation of the wagering game as described below. The processor, memory, or both may be remotely located on the game control network 40. For example, instead of the CPU 30, the game control network 40 may determine the random outcomes for games conducted on the gaming terminal(s) 10. Alternatively, the CPU 30 randomly determines the game outcomes.

The gaming terminal 10 often has multiple serial ports, each port dedicated to providing data to a specific host computer system that performs a specific function (e.g., accounting system, player-tracking system, etc.). To set up a typical serial communication hardware link to the host system, the typical RS-232 point-to-point communication protocol that is often present in the gaming terminal 10 is converted to an RS-485 (or RS-485-type) master-slave protocol so as to take advantage of some of the benefits of the RS-485 capability (e.g., multi-drop capability that allows many gaming terminals 10 to communicate with the game control network 40). To perform this function, a custom interface board may be used by the gaming terminal 10 for each communication port in the gaming terminal 10. It should be noted that the gaming terminal 10 can initially be designed to be configured for a typical RS-485 protocol, instead of the typical RS-232 protocol. Further, the gaming terminal 10 may simply be designed for an Ethernet connection to the game control network 40.

Figure 3:
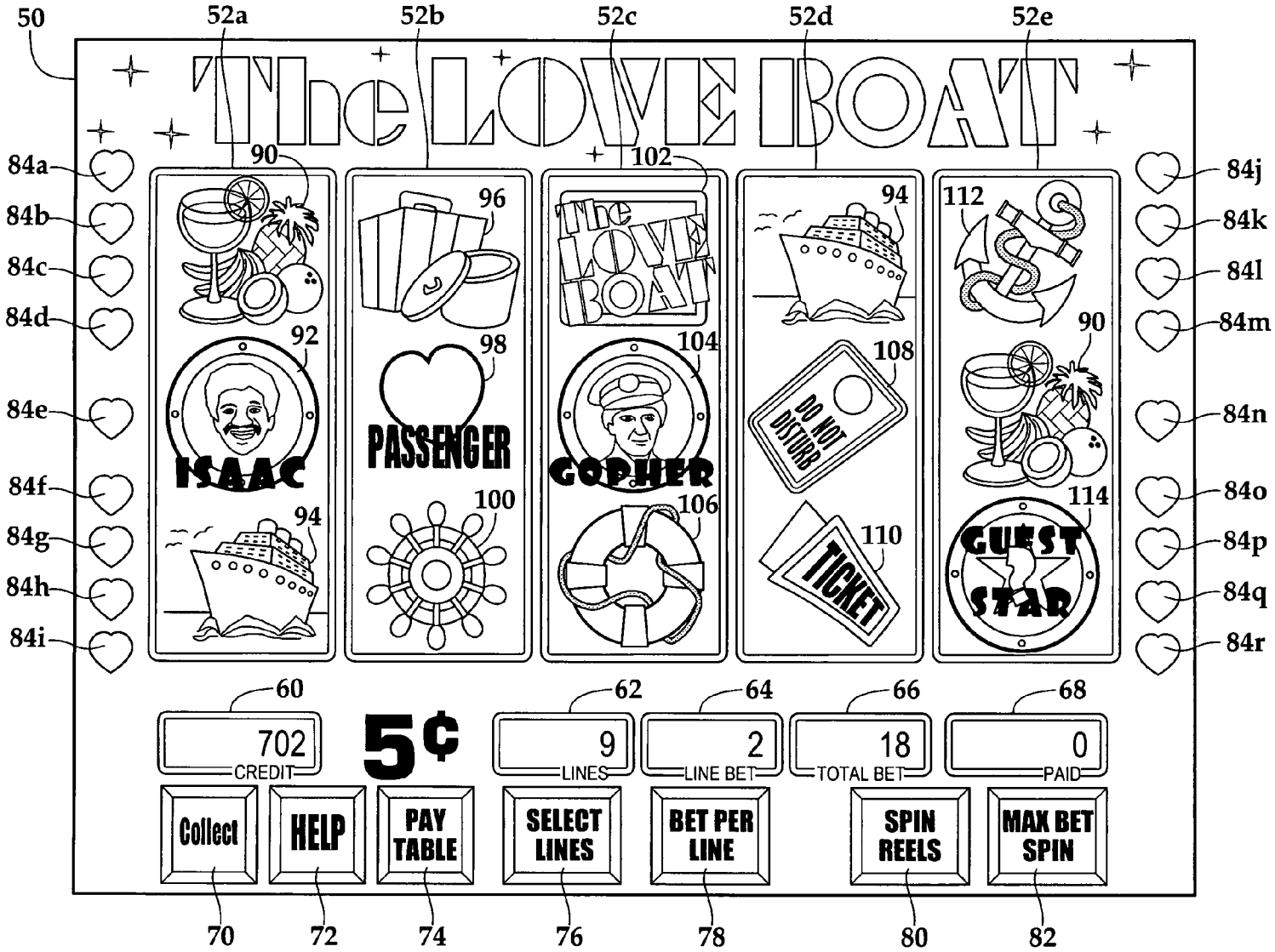
FIG. 3 is a screen view of a basic game capable of being displayed on the gaming terminal of FIG. 1.

Referring now to FIG. 3, an image of a main game screen 50 is illustrated, according to one embodiment of the present invention. A player begins play of a basic wagering game by inserting a wager into the wager input accepter 16 of the gaming terminal 10. A player can select play by either using the touch screen 21 or push-button panel 22. The CPU 30, or the wagering game control network 40 in alternative embodiments, operates to execute a wagering game program causing the main video display 26 to display the wagering game that includes a plurality of visual elements.

The basic game screen 50 may be displayed on the main video display 26 or on a portion thereof. In the illustrated embodiment, the basic game screen 50 is used to display a plurality of simulated, movable reels 52*a-e* with symbols displayed thereon. The reels 52*a-e* are positioned such that the symbols are displayed relative to at least one payline 84, yielding a plurality of outcomes for the basic game. The basic game screen 50 may also display a plurality of game session meters and various buttons selectable by a player. The game session meters include a "credit" meter 60 for displaying a number of credits available for play on the machine; a "lines" meter 62 for displaying a number of paylines to be played by a player on the machine; a "line bet" meter 64 for displaying a number of credits wagered (e.g., from 1 to 5 credits) for each of the number of paylines played; a "total bet" meter 66 for displaying a total number of credits wagered for the particular round of wagering; and a "paid" meter 68 for displaying an amount to be awarded based on the results of the particular rounds wager. The user-selectable buttons include a "collect" button 70 to collect the credits remaining in the credits meter 60; a "help" button 72 for viewing instructions on how to play the wagering game; a "pay table" button 74 for viewing a pay table associated with the basic wagering game; a "select lines" button 76 for changing the number of paylines (displayed in the lines meter 62) a player wishes to play; a "bet per line" button 78 for changing the amount of the wager which is displayed in the line bet meter 64; a "spin reels" button 80 for moving the reels 52*a-e*; and a "max bet spin" button 82 for wagering a maximum number of credits and moving the reels 52*a-e* of the basic wagering game. While the gaming terminal 10 allows for these types of player inputs, the present invention does not require them and can be used on gaming terminals having more, less, or different player inputs.

In FIG. 3, the five depicted reels 52*a-e* have a plurality of symbols displayed thereon and at least one activated payline extending from one of the payline indicators 84*a-i* on the left side of the screen 50 to any one of the payline indicators 84*j-r* on the right side of the screen 50. The plurality of symbols displayed on the plurality of reels 52*a-e* are used to indicate a plurality of possible outcomes along each of the activated paylines. The depicted symbols all correspond to a "THE LOVE BOAT" theme and include: "DRINK" symbols 90; "ISAAC" symbols 92; "BOAT" symbols 94; "LUGGAGE" symbols 96; "PASSENGER" symbols 98; "WHEEL" symbols 100; "THE LOVE BOAT" symbols 102; "GOPHER" symbols 104; "LIFE PRESERVER" symbols 106; "DO NOT DISTURB" symbols 108; "TICKET" symbols 110; "ANCHOR" symbols 112; and "GUEST STAR" symbols 114. Other LOVE-BOAT-themed symbols may also be depicted. In other embodiments of the present invention, the gaming terminal 10 may portray other themes with corresponding like-themed reel symbols. Further, standard gaming symbols such as "1-BAR" symbols, "2-BAR" symbols, "3-BAR" symbols, "CHERRY" symbols, "SEVEN" symbols, and "BELL" symbols may be depicted on the reels 52*a-e* in other embodiments.

A winning combination occurs when the symbols appearing on the reels 52*a-e* correspond to one of the winning symbol combinations listed in a pay table stored in the memory 32 of the gaming terminal 10. The pay table may also be displayed on the secondary display 27, the main display 26, or both and be either displayed constantly, intermittently, or upon request by a player (e.g., by selecting the pay-table button 74). Such winning combinations are displayed relative to one or more paylines 84. The activated paylines 84 extend between activated pairs of payline indicators 84*a-r* such as, for example, the payline that extends between payline indicators 84*e* and 84*n*. Winning combinations listed in the pay table can include three like-symbols appearing on a payline yielding a first payout, four like-symbols appearing on a payline yielding a second, larger payout, and five like-symbols appearing on a payline yielding a third, even larger payout.

The reels 52*a-e* may be either traditional mechanical reels or they may be computer-generated images of reels. The payline indicators 84*a-r* indicate a randomly selected outcome for each payline 84, which is the combination of symbols on the reels 52*a-i* along the particular payline 84. A player may play multiple paylines 84 by selecting the select-lines button 76 until the desired number of paylines 84 (up to nine in the illustrated embodiment) are displayed. While an embodiment with nine paylines is shown, a gaming terminal 10 with a single payline, or multiple paylines will also work with the present invention. Additionally, though an embodiment with five reels is shown, a gaming terminal 10 with any plurality of reels may also be used in accordance with the present invention.

Figure 4:
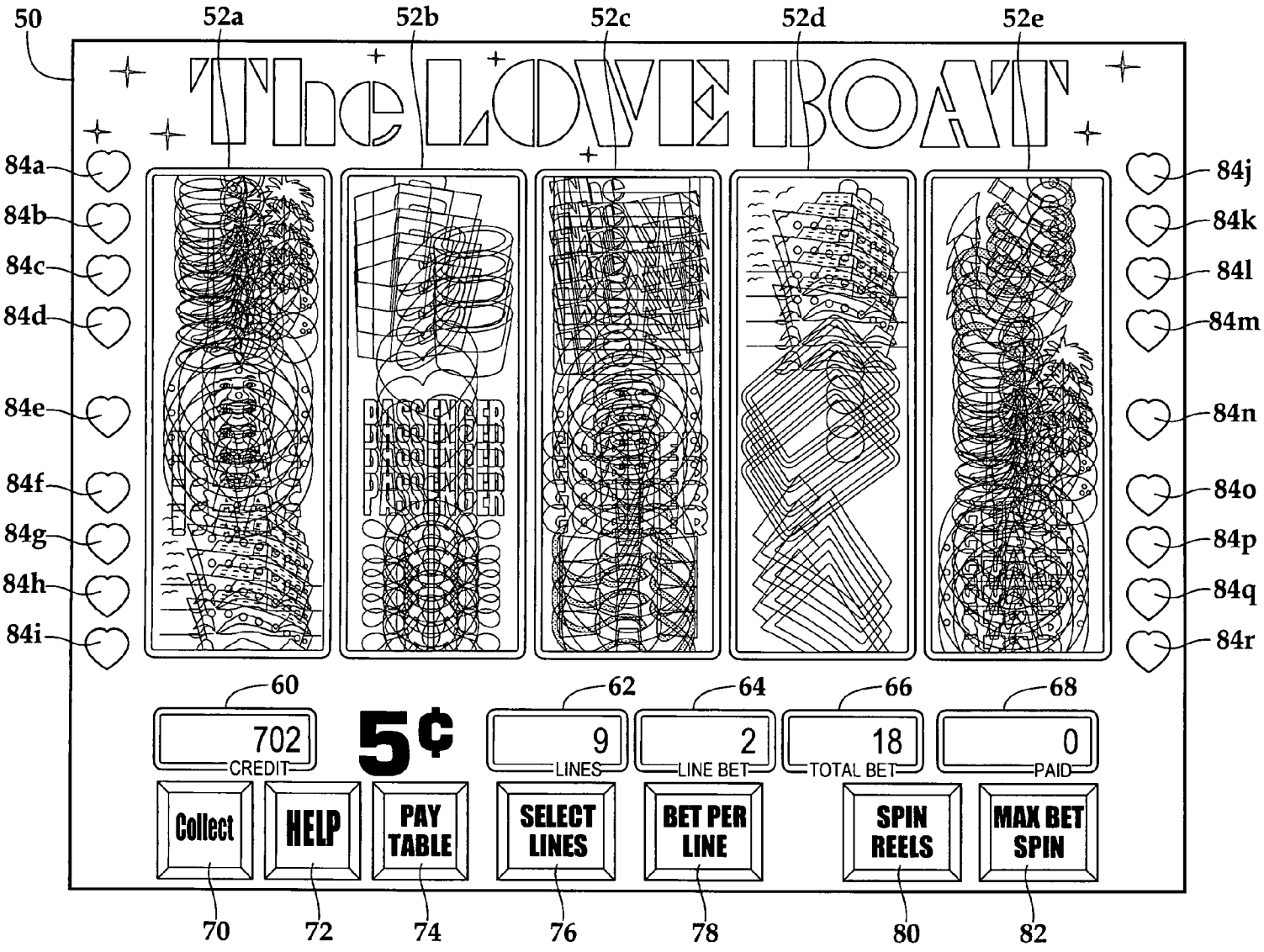
FIG. 4 is a screen view of the moving reels on the basic game of FIG. 3, according to one embodiment of the present invention.

Referring now to FIG. 4, the main game screen 50 is shown once the reels 52*a-e* have begun to move. A player may make the reels move by placing a wager using the select-lines button 76, the bet-per-line button 78 and the spin-reels button 80, or by selecting the max-bet-spin button 82. Once the reels 52*a-e* have begun to move, one of two game-play options may occur. In the first game-play option, the reels 52*a-e* may come to a stop, revealing the displayed symbols along or adjacent to the paylines 84, and an award may be granted if the combination of symbols correspond to one of the winning symbol combinations listed in a pay table. In the second game-play option, the symbols on the reels 52*a-e* remain at least partially unrevealed (as shown in FIG. 3, the reels 52 remain moving), and a special-feature will occur prior to revealing the randomly displayed symbols in their final state.

Figure 5:
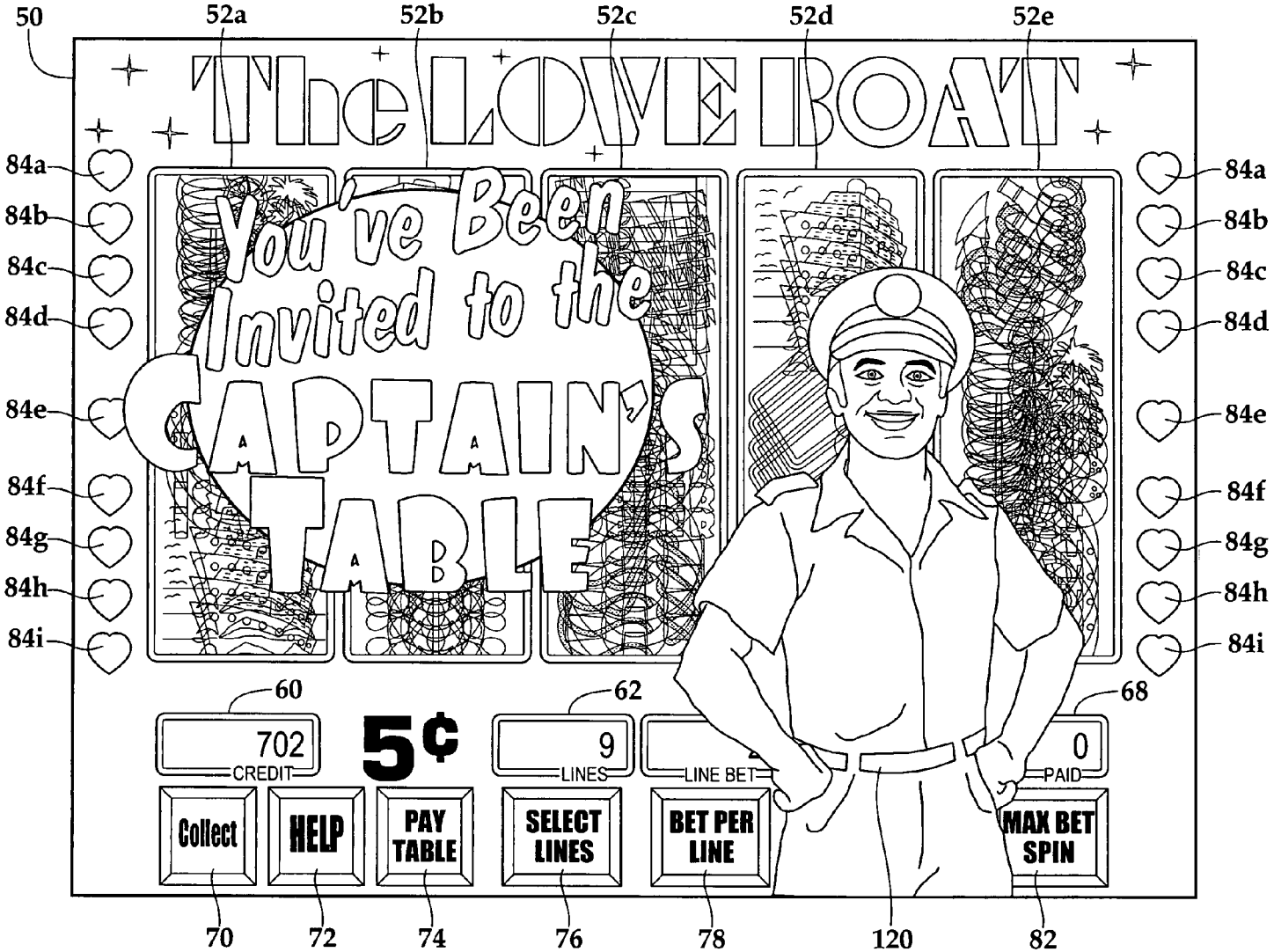
FIG. 5 is a screen view of a visual element displayed overtop of the moving reels of FIG. 4, according to one embodiment of the present invention.

In FIG. 5, a visual element 120 is displayed on top of the moving reels of FIG. 4. The visual element 120 is used to indicate to a player that a special-feature has occurred and that a secondary game has been initiated. When the visual element 120 is displayed, a player's spin is interrupted and a secondary or bonus game is initiated. According to one embodiment of the invention, the visual element 120 is a picture of the captain informing the player that they have been invited to the "CAPTAIN'S TABLE." The illustrated captain represents CAPTAIN STUBBING from the original "THE LOVE BOAT" television series. The visual element 120 may be accompanied by an audio element as well. For example, the audio element could be a tone or tones, music, words, phrases, etc.

Examples of phrases that may be used as an audio element are, "Welcome, Come on and join me and my other guests at the Captain's Table," "Come join my Guests and I at the Captain's Table," "You been invited to join us at the Captain's Table," "Congratulations . . . Come and join me and my other guests at the Captain's Table," "You have been cordially invited to dine at the Captain's Table," "A seat at the Captain's Table has been reserved especially for you," etc.

According to one embodiment of the invention, when the visual element 120 is displayed, the reels 52*a-e* continue to spin until the secondary or bonus game is completed. Alternatively, one or more of the reels 52*a-e* could be stopped, while one or more of the reels continue to move. Then, once the secondary game has completed, the remaining spinning reels would be stopped.

Figure 6:
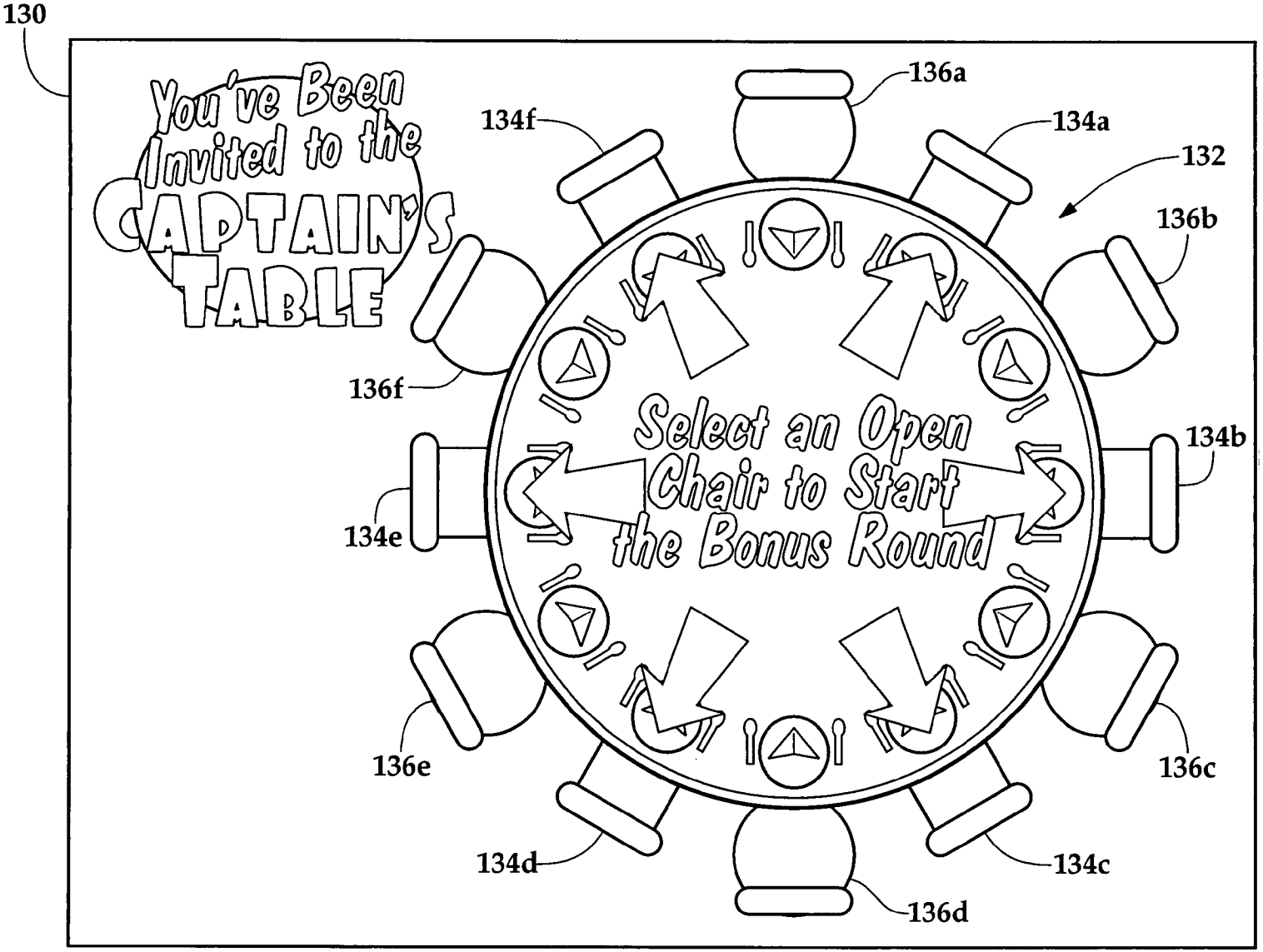
FIG. 6 is a screen view of a secondary game screen capable of being displayed on the gaming terminal of FIG. 1, according to one embodiment of the present invention.

Referring now to FIG. 6, a secondary game screen 130 is shown according to one embodiment of the present invention. The secondary game screen 130, which may be displayed on the main display 26 or the secondary display 27, includes a visual representation of the CAPTAIN'S TABLE 132. The CAPTAIN'S TABLE 132, according to the illustrated embodiment, is a circular table that includes a plurality of user-selectable seats 134*a-f* located between a plurality of secondary objects, for example, guest seats 136*a-f*. When the CAPTAIN'S TABLE 132 is first displayed to a player the guest seats 136*a-f* are empty. Thus, a player is unaware of the guests at the table or the location at which each of the guests are sitting. A player is prompted, with an audio element for example, to select from one of the available user-selectable seats 134*a-f*. A player may then select at least one of the user-selectable seats 134*a-f* by manipulating the touch screen 21 or a button located on the push-button panel 22.

Examples of phrases that may be used as an audio element to prompt a user to select a seat are, "Go ahead and pick a place to sit," "Where would you like to sit tonight," "Sit wherever you like," "Pick a place to sit for tonight's dinner," "Please . . . go ahead and choose a seating location," "Please . . . have a seat," "Where will you like to be seated tonight," etc.

Figure 7A:
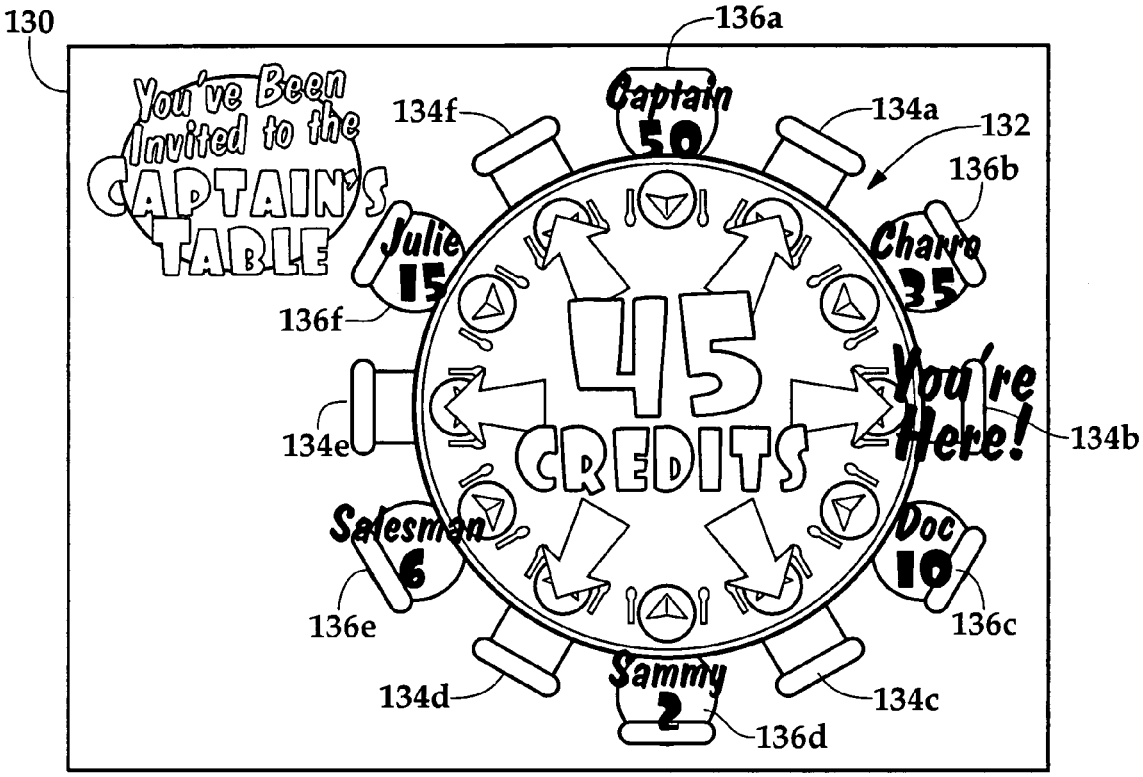
FIG. 7*a* is a screen view of the secondary game screen of FIG. 6.

Referring now to FIG. 7*a*, the CAPTAIN'S TABLE 132 is illustrated according to one embodiment of the present invention. Once a player has selected their user-selectable seat 134, the guest seats 136*a-f* are filled with guests as illustrated in FIG. 7*a*. Each of the guests is accompanied by an award value which is available to the player if the player selects a user-selectable seat 134*a-f* next to the guest seat 136*a-f* occupied by the guest. Thus, according to one embodiment, the player is awarded the value accompanying each guest sitting on both the right and left of the seat selected by the player.

The guests who are seated at the CAPTAIN'S TABLE 132 are selected from a pool of guests defined in the memory 32 of the gaming terminal 10 or the network 40. According to one embodiment of the present invention, a high-value guest (e.g., THE CAPTAIN) is always included among the selected guests. Additionally, a low-value guest (e.g., SEASICK SAMMY) is always included among the selected guests. According to one embodiment of the invention where both a high-value and low-value guest are seated at the table (and the table comprises six guest seats), the remaining guests are randomly selected from the guest pool and seated such that the second-lowest-value guest and the third-lowest-value guest are seated in the guest seats adjacent the low-value guest. Similarly, the second-highest-value guest and the third-highest-value guest are seated in the guest seats adjacent the high-value guest.

Alternatively, according to another embodiment of the present invention, the pool comprises only the number of guests necessary to fill each of the guest seats at the CAPTAIN'S TABLE 132. In this embodiment, the guests are repeatedly seated in the guest seats 136*a-f* in a variety of randomly generated configurations.

As illustrated in FIG. 7*a*, in this example, the player has selected user-selectable seat 134*b* which is between a first guest seat 136*b* and a second guest seat 136*c*. In the illustrated example, the first guest seat 136*b* is occupied by CHARRO with an accompanying award value of 35 credits. The second guest seat 136*c* is occupied by DOC with an accompanying award value of 10 credits.

Figure 7B:
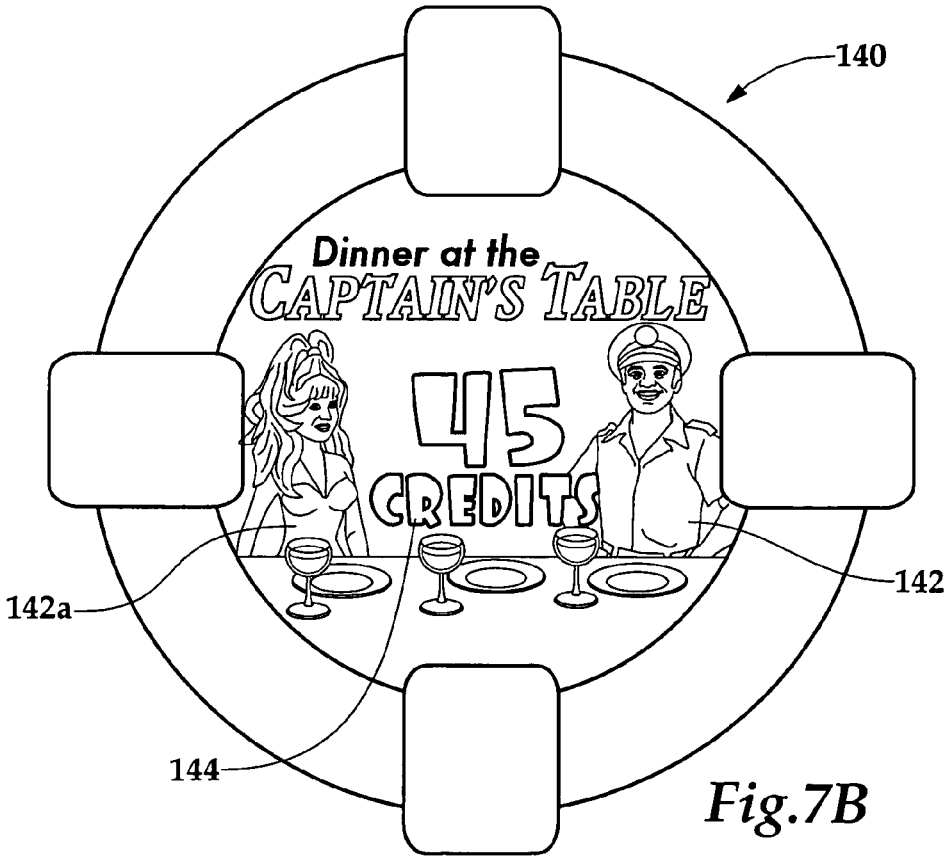
FIG. 7*b* is a screen view of a bonus screen capable of being displayed on the gaming terminal of FIG. 1.

Referring now to FIG. 7*b*, a bonus screen 140 is illustrated according to one embodiment of the present invention. The bonus screen 140 includes a representation of the guests 142*a-b* seated adjacent to the user-selectable seat 134*b* selected by the player. The bonus screen 140 also includes a bonus-award value 144 to be awarded the player for their selection. The bonus-award value 144 is determined by adding both of the accompanying award values for each of the adjacent guests 142*a-b*. Thus, by adding the accompanying award value of 35 credits for CHARRO with the accompanying award value of 10 credits for DOC, the bonus-award value 144 is determined to be 45 credits in the illustrated example. Once the bonus-award value 144 has been awarded, a player is returned to their spin that was interrupted by the secondary game.

An audio element may be utilized to indicate to a player that they are being returned to the basic wagering game. Examples of phrases that may serve as the audio element include, "Excellent," "Wonderful," "Great," "Ooh," "Now let's return you to that spin," "Let's get back to your spin," "Now you can back to your spin," etc.

Figure 8:
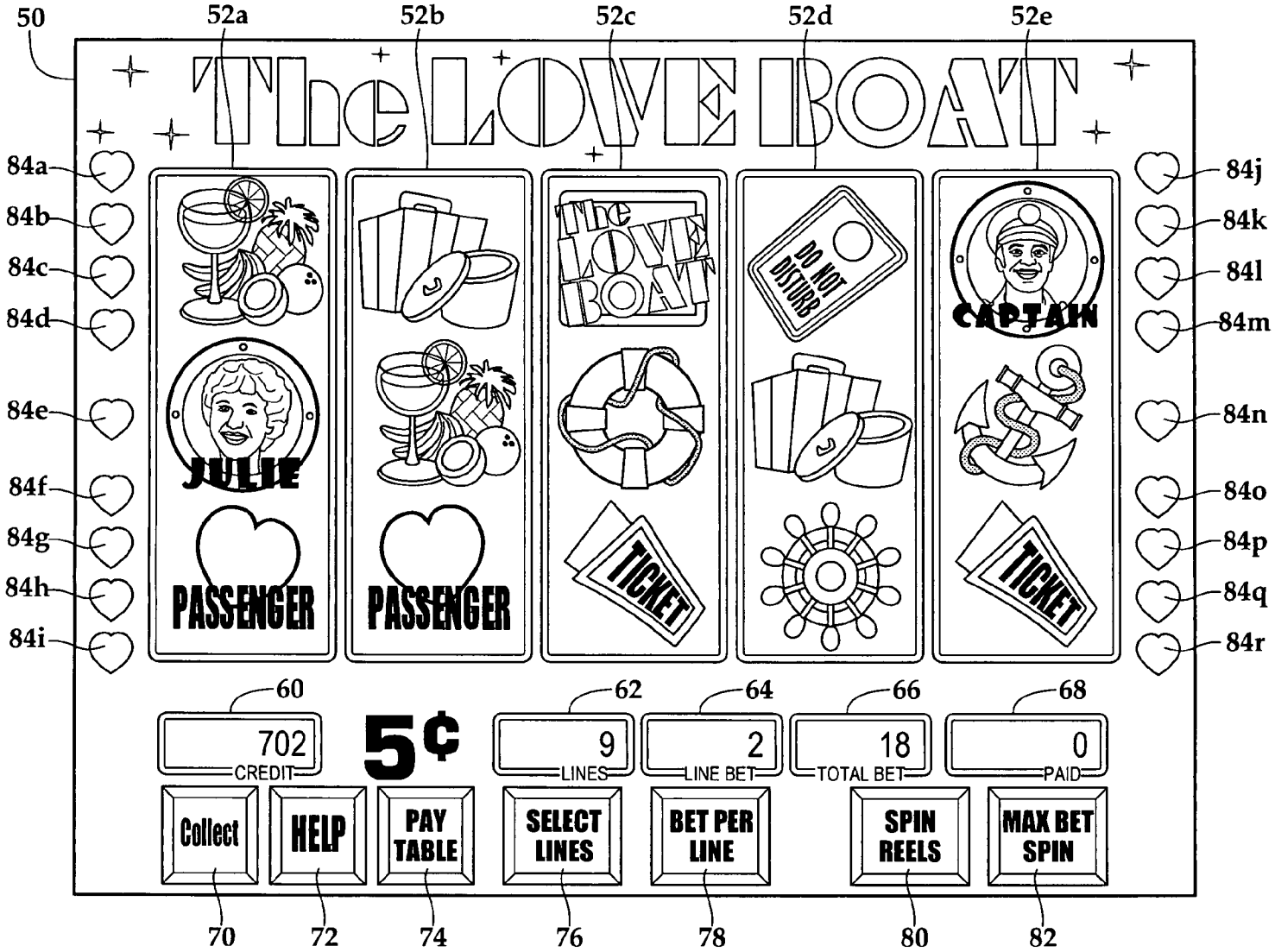
FIG. 8 is a screen view of the completion of the basic game of FIG. 3.

Referring now to FIG. 8, after the bonus game of FIGS. 6-7 has been completed, the main game screen 50 is shown and one possible conclusion to the basic wagering game is illustrated. At the conclusion of the basic wagering game, the reels 52*a-e* are stopped and a plurality of symbols are displayed to a player via the main video display 26. A player is awarded a payout based on the ranking of the symbols in each of the activated paylines 84 in comparison with a pay table. The payout of the basic wagering game is independent from the outcome of the secondary or bonus game. The payout is displayed to a player in the paid meter 68. Once a player has been issued a payout, the basic wagering game ends and a player is prompted to play another game. A player may activate another game by utilizing the select-lines button 76, the bet-per-line button 78, the spin-reels button 80, and the max-bet-spin button 82. Alternatively, a player may choose not to play another game and utilize the collect button 70 to collect the remaining credits, if any, displayed in the credit meter 60.

As discussed above, the secondary or bonus game is an independent event which does not affect the outcome of the basic wagering game. The interrupting secondary game is randomly generated after the basic wagering game's spin is initiated but before the reels 52*a-e* have stopped. Regardless of the outcome of the secondary or bonus game, the outcome of the basic wagering game is unaffected, and in certain embodiments, determined prior to the secondary game's initiation. In embodiments where the secondary or bonus game is displayed on the secondary display 27, the reels 52*a-e* may stay in their state of motion, thereby emphasizing to the player that the basic game is still ongoing.

Though the present invention has been described in association with a slot machine game, it is contemplated that the invention can be used with a variety of wagering games, such as, for example, poker, blackjack, keno bingo, roulette, etc. For example, when the present invention is used in association with a five-card-draw-poker wagering game, the secondary game may be initiated, prior to the initial five-card hand being dealt or before the discarded cards are replaced. The visual element 120 may appear on top of the dealer, dealer's hand, or the player's initial five-card hand, discarded hand, or replacement hand.

It is to be understood that the secondary game of the present invention may take a number of alternative embodiments, without departing from the scope of the invention. For example, the bonus table of the present invention could have any number of user-selectable seats from which a player by select. Further, a player may be allowed to select a plurality of seats at the table. Additionally, although the bonus table is generally round in the illustrated embodiment, it should be clear that the table could be of any shape (e.g., rectangular, square, diamond, oval, etc.).

While the present invention has been described with reference to one or more particular embodiments, those skilled in the art will recognize that many changes may be made thereto without departing from the spirit and scope of the present invention. Each of these embodiments and obvious variations thereof is contemplated as falling within the scope of the claimed invention, which is set forth in the following claims.

What is claimed is:

1. A method of conducting a wagering game, comprising:

receiving a wager from a player to play a single play of a basic wagering game;

displaying the basic wagering game on a video display;

interrupting the single play of the basic wagering game by interposing a visual element over the basic wagering game on the video display, the basic wagering game at least partially viewable on the video display during the interrupting;

initiating a secondary game once the basic game has been interrupted;

returning to the single play of the basic game; and displaying an outcome for the single play of the basic wagering game after the secondary game has been completed.

2. The method of claim 1, the secondary game including the steps of (i) providing a plurality of user-selectable objects and a plurality of secondary objects, (ii) selecting at least one of the user-selectable objects, via player selection, the selected user-selectable object being located between at least two secondary objects, (iii) providing an accompanying award value for each of the at least two secondary objects, and (iv) awarding a bonus-award to the player at the conclusion of the secondary game, wherein the bonus-award's value is determined by combining the accompanying award values for each of the at least two secondary objects.

3. The method of claim 2, wherein the user-selectable objects and secondary objects are empty seats at a table.

4. The method of claim 1, wherein the basic wagering game is a slot machine game including a plurality of symbol-bearing reels.

5. The method of claim 4, wherein the interrupting of the slot machine game is performed by obstructing the view of at least a portion of the reels of the slots game with a visual element.

6. The method of claim 1, wherein the basic wagering game is a spinning reel wagering game.

7. The method of claim 1, wherein the basic wagering game is poker.

8. The method of claim 1, wherein the basic wagering game is keno.

9. The method of claim 1, wherein the basic wagering game is bingo.

10. The method of claim 1, wherein the basic wagering game is blackjack.

11. The method of claim 1, wherein the basic wagering game is roulette.

12. A method of conducting a wagering game, comprising:

receiving a wager from a player to play a single play of a basic wagering game;

displaying the basic wagering game on a video display the basic wagering game including a plurality of reels capable of being moved, each reel including a plurality of symbols;

interrupting the single play of the basic wagering game by interposing a visual element over the basic wagering game on the video display, the basic wagering game at least partially viewable on the video display during the interrupting;

initiating a secondary game after interrupting the basic wagering game;

awarding a bonus-award to the player at the conclusion of the secondary game, the bonus-award value being determined by the secondary game;

returning to the single play of the basic game; and displaying an outcome for the single play of the basic wagering game after the secondary game has concluded, the outcome for the basic wagering game being independent from the secondary game.

13. The method of claim 12, the secondary game including the steps of (i) providing a plurality of user-selectable objects and a plurality of secondary objects, (ii) selecting at least one of the user-selectable objects, via player selection, the selected user-selectable object being located between at least two secondary objects, (iii) providing an accompanying award value for each of the at least two secondary objects, and (iv) awarding a bonus-award to the player at the conclusion of the secondary game, wherein the bonus-award's value is determined by combining the accompanying award values for each of the at least two secondary objects.

14. The method of claim 13, wherein the user-selectable objects are empty seats at a table.

15. The method of claim 14, the secondary game including the step of revealing a guest that occupies each of the empty seats after at least one of the user-selectable objects has been selected.

16. The method of claim 12, further comprising stopping at least one of the moving reels of the basic wagering game when the game is interrupted while at least one of the moving reels remains in motion.

17. A method of conducting a wagering game, comprising:

receiving a wager from a player to play a single play of a slot game, the slot game including a plurality of symbol-bearing reels adapted to move;

moving the plurality of symbol-bearing reels;

interrupting the single play of the slot game with a visual element, the visual element covering at least a portion of the moving plurality of symbol-bearing reels, and allowing at least a portion of the moving plurality of symbol-bearing reels to be visible;

initiating a secondary game after interrupting the slot game;

awarding a bonus-award to the player at the conclusion of the secondary game, wherein the bonus-award value is determined by the secondary game;

returning to the single play of the slot game; and displaying an outcome for the single play of the slot game after the bonus-award has been awarded.

18. The method of claim 17, wherein the slot game is displayed on a main display of a gaming terminal and the secondary game is displayed on a secondary display of the gaming terminal.

19. The method of claim 17, further comprising stopping at least one of the moving symbol-bearing reels when the visual element is displayed while at least one of the moving reels remains in motion.

20. The method of claim 18, wherein the symbol-bearing reels remain in motion when the slot game is interrupted with the visual element.

21. A method of conducting a wagering game, comprising:

receiving a wager from a player to play a single play of a basic wagering game;

displaying the basic wagering game on a video display;

interrupting the single play of the basic wagering game by interposing a visual element over the basic wagering game on the video display, the basic wagering game at least partially viewable on the video display during the interrupting, wherein a secondary game is initiated once the basic game is interrupted, the secondary game including a plurality of user-selectable objects;

selecting at least one of the user-selectable objects, via player selection, the selected user-selectable object being located between at least two secondary objects;

providing an accompanying award value for each of the at least two secondary objects;

awarding a bonus-award to the player at the conclusion of the secondary game, wherein the bonus-award's value is determined by combining the accompanying award values for each of the at least two secondary objects;

returning to the single play of the basic game; and displaying an outcome for the single play of the basic wagering game after the bonus-award has been awarded.

22. The method of claim 21, wherein a highest-value secondary object and a lowest-value secondary object are provided as secondary objects.

23. The method of claim 22, wherein the highest-value secondary object is positioned opposite from the lowest-value secondary object.

24. The method of claim 23, wherein a second-highest-value secondary object, a third-highest-value secondary object, a second-lowest-value secondary object, and a third-lowest-value secondary object are provided as secondary objects.

25. The method of claim 24, wherein the second-highest and third-highest value secondary objects are the secondary objects nearest the highest-value secondary object and the second-lowest and third-lowest value secondary objects are the secondary objects nearest the lowest-value secondary object.

26. The method of claim 21, wherein the basic wagering game is a slot machine wagering game.

27. A gaming system capable of conducting a wagering game, the system comprising:

a wager receptor for receiving a wager from a player to play a single play of a basic wagering game;

a display for displaying (i) a plurality of reels adapted to be moved, (ii) an interruption of the single play of the basic wagering game including the interposition of a visual element over the plurality of reels, the plurality of reels at least partially viewable on the display during the interruption;

(iii) a secondary game, the secondary game including a plurality of user-selectable objects located between a plurality of secondary objects;

an input device adapted to allow the player to select one or more of the user-selectable objects included in the secondary game;

a system memory capable of storing an accompanying award value pool and a pay table thereon; and a processor coupled to the system memory, the input device, and the display and operative to (i) associate each of the selected accompanying award values with at least one of the secondary objects, (ii) determine a bonus-award value by combining the accompanying award values for each of the secondary objects adjacent the selected user-selectable object, (iii) award the player the determined bonus-award value, and (iv) display an outcome for the single play of the basic wagering game after the bonus-award has been awarded, the displayed outcome for the single play of the basic wagering game being independent from the secondary game.

28. The gaming system of claim 27, further comprising an interface with a network, wherein the processor and system memory are located on the network.

29. The gaming system of claim 27, wherein the plurality of user-selectable objects and the plurality of secondary objects are positioned around a table in the secondary game.

30. The gaming system of claim 29, wherein each one of the plurality of user-selectable objects is located between two secondary objects, each secondary object being located between two user-selectable objects.

31. The gaming system of claim 30, wherein a highest of the selected accompanying values and a lowest of the selected accompanying values are positioned opposite from each other at the table.

32. The gaming system of claim 31, wherein a second-highest of the selected accompanying values and a third-highest of the selected accompanying values are positioned nearest the highest of the selected accompanying values.

33. The gaming system of claim 31, wherein a second-lowest of the selected accompanying values and a third-lowest of the selected accompanying values are positioned nearest the lowest of the selected accompanying values.

34. The gaming system of claim 27, wherein the accompanying award-value pool includes more accompanying award values than there are secondary objects.

35. The gaming system of claim 27, the processor being further operative to randomly select a plurality of accompanying award values from the accompanying award-value pool.

36. A gaming system capable of conducting a wagering game, the system comprising:

a wager receptor for receiving a wager from a player to play a single play of a basic wagering game;

a main display for displaying a basic wagering game;

a secondary display for displaying a secondary game;

an input device adapted to allow the player to interact with both the basic wagering game and the secondary game;

a system memory capable of storing a basic wagering game pay table and a secondary game award pool thereon; and a processor coupled to the system memory, the input device, the main display, and the secondary display and operative to (i) determine a bonus-award value based on the result of the secondary game when compared to the award pool, (ii) award the player the determined bonus-award value after interrupting the single play of the basic wagering game, and (iii) display an outcome for the single play of the basic wagering game after returning to the single play of the basic wagering game and the bonus-award has been awarded.

37. The gaming system of claim 36, further comprising an interface with a network, wherein the processor and system memory are located on the network.

38. The gaming system of claim 36, wherein a visual element is displayed on the main display over at least a portion of the basic wagering game until the bonus-award has been awarded.

* * * * *